US008299871B2

(12) United States Patent
Carrillo-Ramirez

(10) Patent No.: US 8,299,871 B2
(45) Date of Patent: Oct. 30, 2012

(54) DIRECTIONAL COUPLER

(75) Inventor: Rodrigo Carrillo-Ramirez, Chelmsford, MA (US)

(73) Assignee: Analog Devices, Inc., Norwood, MA (US)

( * ) Notice: Subject to any disclaimer, the term of this patent is extended or adjusted under 35 U.S.C. 154(b) by 285 days.

(21) Appl. No.: 12/707,327

(22) Filed: Feb. 17, 2010

(65) Prior Publication Data

US 2011/0199166 A1 Aug. 18, 2011

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 115, 116, 238
See application file for complete search history.

(56) References Cited

U.S. PATENT DOCUMENTS 4,027,254 A 5/1977 Gunton et al.
4,178,568 A * 12/1979 Gunton ..... 333/116
4,376,921 A 3/1983 Dickens et al.
4,394,630 A 7/1983 Kenyonet al.
4,999,593 A 3/1991 Anderson
6,150,898 A 11/2000 Kushitani et al.
6,549,089 B2 4/2003 Ashoka
6,686,808 B1 * 2/2004 Sugawara et al. ..... 333/1
6,825,738 B2 11/2004 Shumovich
6,946,927 B2 * 9/2005 Allen et al. ..... 333/116
7,084,715 B2 8/2006 Al-Taei et al.
7,119,633 B2 10/2006 Stoneham
7,138,887 B2 11/2006 Podell
7,239,219 B2 7/2007 Brown et al.
7,298,229 B1 11/2007 Ruelke
7,394,333 B2 7/2008 Ezzeddine et al.
7,525,397 B2 4/2009 Schmidt
2002/0113667 A1 8/2002 Tahara et al.
2003/0011442 A1 1/2003 Ashoka
2007/0001780 A1 1/2007 Nichols
2007/0279147 A1 12/2007 Dupont et al.
2009/0051461 A1 2/2009 Huang et al.

* cited by examiner

*Primary Examiner* — Dean O Takaoka
(74) *Attorney, Agent, or Firm* — Knobbe Martens Olson & Bear LLP

(57) ABSTRACT

In a directional coupler having flaps on a pair transmission lines to be coupled, structural characteristics such as the distance between adjacent flaps, the length and width of a flap, the direction of projection of the flaps, and whether and to what degree the flaps on the two transmission lines overlap can be selected in order to optimize electrical characteristics of the coupler.

33 Claims, 3 Drawing Sheets

DIRECTIONAL COUPLER

TECHNICAL FIELD

The present invention relates to microwave directional couplers, and more particularly to a directional coupler which is small in length and achieves high directivity.

BACKGROUND

Directional couplers have been used in various telecommunication devices such as wireless and radar systems, and also in power sources for monitoring microwave power. A coupler typically comprises a pair of electromagnetically coupled transmission lines and four ports: input, through, coupled, and isolated. The term "main line" generally refers to the transmission line between the input and through ports. The coupled port of the directional coupler can be used to obtain information such as frequency and power level of the signal on the main line without substantially interrupting the power flow on the main line and independently of the termination at the through port.

The "coupling factor" of a directional coupler relates the power output at the coupled port to the power input at the input port. Similarly, the "directivity" of a directional coupler relates the power output at the coupled port to the power output at the isolated port. High directivity helps to differentiate between the power supplied at the input port and the port reflected back due to mismatch at the through port. A directional coupler is generally designed to exhibit a desired coupling factor and high directivity. Thus, an important goal of a directional coupler is to monitor the power from the source to provide a desired power level at the through port while isolating the variation due to the load at the through port.

The coupling factor and directivity of a directional coupler vary with frequency of the signal to be transmitted and the impedance of the transmission line, which itself varies according to the frequency of the signal to be transmitted. A signal transmitted along a directional coupler has two phase velocities, namely, an even-mode phase velocity and an odd-mode phase velocity. The directivity of the coupler is high when the two velocities are identical or nearly identical. The directivity decreases, however, when the two velocities are different. The even-mode and odd-mode phase velocities can be changed by varying the impedance of the conductors in the directional coupler, but changing impedance can also result in altering the coupling factor so that the desired level of coupling is no longer achieved.

Solutions have been offered to provide high directivity such that a desired coupling factor can be maintained over a large frequency range (i.e. large bandwidth). Some of these solutions, however, require long conductors, typically of length at least one-fourth the wavelength of the signal to be transmitted. A long directional coupler may not be suitable for use, e.g., in a microcircuit or a computer chip and may also reduce the total power at the through port due to dissipation losses associated with a long conductor. Some previous solutions have provided for balancing the even-mode and odd-mode phase velocities, so as to achieve high directivity, when one type of phase velocity is greater than the other—e.g., by altering the even or odd mode transmission line impedance. Unfortunately, this alters the coupling factor from its desired value. Therefore, there is a need for a directional coupler that is small in length and can balance even-mode and odd-mode phase velocities (when either velocity can be greater than the other) over a large frequency range, without substantially altering the desired coupling.

SUMMARY

Directional couplers in accordance with the present invention can be small in length and can balance even-mode and odd-mode phase velocities when either velocity can be greater than the other without substantially altering the desired coupling and therefore simultaneously achieving high directivity and low loss. This is generally achieved by functionally dividing a pair of transmission lines into multiple sections. The geometry of each section simultaneously determines various electrical characteristics of the section such as mutual inductance, inductance, coupling capacitance, and transmission line-to-ground capacitance. Controlling these electrical characteristics collectively allows for balancing of even-mode and odd-mode phase velocities over a large range of frequencies without substantially changing the coupling factor, while allowing the total length of conductors to be only one-tenth of the wavelength of the signal to be transmitted.

In one aspect, embodiments of the invention feature a structure in which flaps are attached to each conductor in a pair. In particular, a microwave directional coupler in accordance with the invention may comprise a first conductor, a second conductor spaced apart from but parallel to the first conductor, a plurality of spaced-apart flaps projecting from the first conductor, and a plurality of spaced-apart flaps projecting from the second conductor. In general, the second-conductor flaps are non-coplanar with the first-conductor flaps.

One or more structural characteristics of the conductors can be varied in order to achieve one or more desired electrical characteristics. For example, it is possible to vary the distance between the conductors; the distance between adjacent flaps of the first conductor; the distance between adjacent flaps of the second conductor; the direction of a flap, that is, whether the flap of one conductor projects toward or away from the other conductor, or projects in both directions. The length and width of a flap (or the two parts of a multi-part flap) may be selected to achieve a desired coupling between the two conductors and to balance the even-mode and odd-mode phase velocities of a signal travelling across the coupler, while simultaneously minimizing the length of each conductor.

The distance between two adjacent flaps determines (or is at least related to) the inductance of the part of the conductor between the two adjacent flaps. The length and width of a part of a flap of one conductor projecting away from the other conductor determine (or are at least related to) the capacitance between the flap and ground. The length and width of a part of a flap of a conductor projecting toward the other conductor determine (or are at least related to) a coupling capacitance. Therefore, by selecting the above-mentioned lengths and widths, the values of inductances and capacitances associated with a section of a coupler can be controlled. Controlling these values for one or more sections, in turn, allows a desired coupling to be achieved between the two conductors while maintaining high directivity. In addition, the length of the two conductors may thereby be decreased substantially.

Accordingly, in some embodiments, at least a portion of the first-conductor flaps projects in a first direction substantially orthogonal to an axial dimension of the first conductor. Alternatively or in addition, at least a portion of the first-conductor flaps may project in a second direction substantially orthogonal to an axial dimension the first conductor. For example, the second direction may be opposite to the first direction.

Similarly, at least a portion of the second-conductor flaps may project in a first direction substantially orthogonal to an axial dimension of the second conductor. Alternatively or in addition, at least a portion of the second-conductor flaps projects in a second direction substantially orthogonal to an axial dimension of the second conductor. For example, the second direction may be opposite to the first direction.

The portion of the first-conductor (and/or second-conductor) flaps projecting in the first direction and the portion of the first-conductor (and/or second-conductor) flaps projecting in the second direction can have lengths and widths such that a pre-selected coupling factor is associated with the microwave directional coupler, and microwave signals traveling across the coupler have even-mode phase velocities and odd-mode phase velocities that are substantially similar. Thus, to design a directional coupler having a desired coupling factor, the lengths and widths of the first-conductor (and/or second-conductor) flaps projecting in the first direction and the portion of the first-conductor (and/or second-conductor) flaps projecting in the second direction may be selected to produce the desired coupling factor.

In some embodiments, at least a portion of the first-conductor flaps overlaps with at least a portion of the second-conductor flaps without contact therewith. The first and second conductors may be separated by a distance such that a pre-selected coupling factor is associated with the microwave directional coupler, and microwave signals traveling across the coupler have even-mode phase velocities and odd-mode phase velocities that are substantially similar. The first-conductor flaps and/or the second-conductor flaps may be separated by a distance such that a pre-selected coupling factor is associated with the microwave directional coupler, and microwave signals traveling across the coupler have even-mode velocities and odd-mode velocities that are substantially similar. Thus, to design a directional coupler having a desired coupling factor, the distance between the first-conductor (and/or second-conductor) flaps may be selected to produce the desired coupling factor.

Overlapping portions of the first-conductor flaps and second-conductor flaps may have lengths and widths such that a pre-selected coupling factor is associated with the microwave directional coupler, and microwave signals traveling across the coupler have even-mode phase velocities and odd-mode phase velocities that are substantially similar. It should be understood, however, that in some embodiments, the first-conductor flaps and the second-conductor flaps do not overlap.

The distance by which a flap (except for a first flap) is separated from the immediately preceding flap may be identical for each flap or may vary. The distance between the two conductors can establish the mutual inductance. Accordingly, a designer may set these distances to achieve a desired coupling factor and directivity.

BRIEF DESCRIPTION OF THE DRAWINGS

The invention and various embodiments and features may be better understood by reference to the following drawings in which.

DETAILED DESCRIPTION

Figure 1:
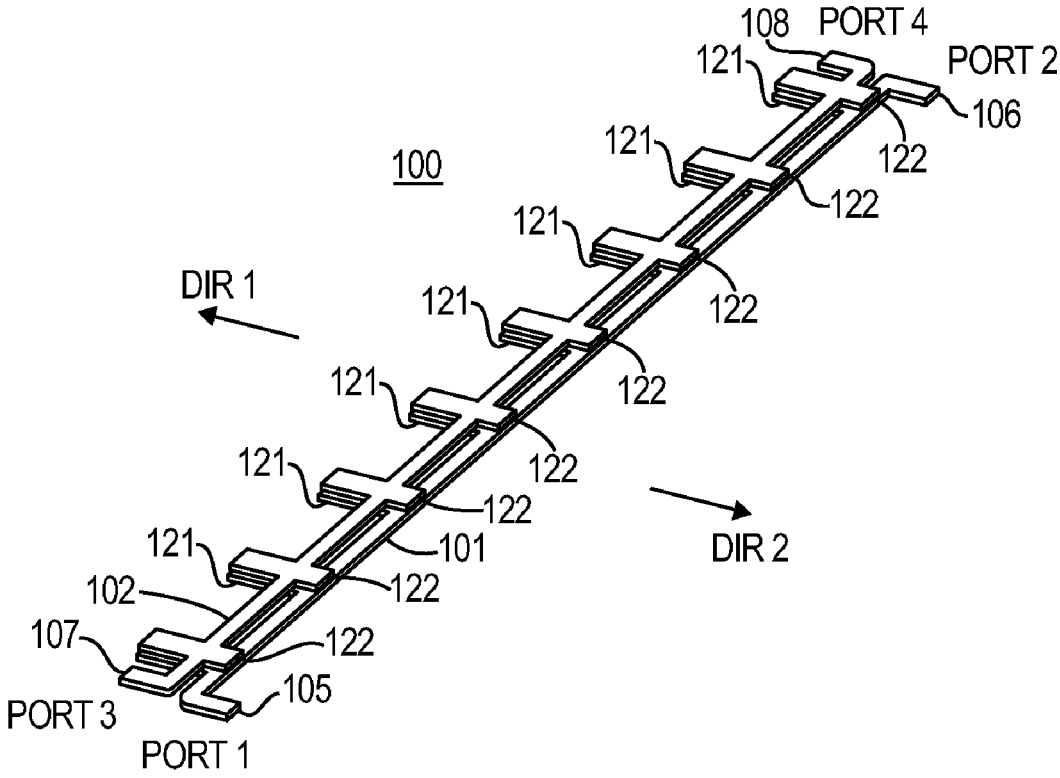
FIG. 1 is a perspective view of an exemplary directional coupler.

An exemplary directional coupler 100 according to the present invention is shown in FIG. 1. A first conductor 101 has two ports, namely Port1 (indicated at 105) and Port2 (indicated at 106). Port1 and Port2 can be the input and through ports, respectively, of the coupler 100. A second conductor 102 also has two ports, namely, Port3 (indicated at 107) and Port4 (indicated at 108). Port3 and Port4 can be the coupled and terminated ports, respectively, of the coupler 100. Conductor 102 is spaced apart from and substantially parallel to conductor 101, but as shown in FIG. 2B, conductors 101, 102 are typically offset laterally. A series of flaps 121 project substantially orthogonally from conductor 101 and a series of flaps 122 project substantially orthogonally from conductor 102. In the illustrated embodiment, flaps 121 project in direction DIR1. Flaps 122 project in both direction DIR1 and the opposite direction DIR2.

Figure 2A:
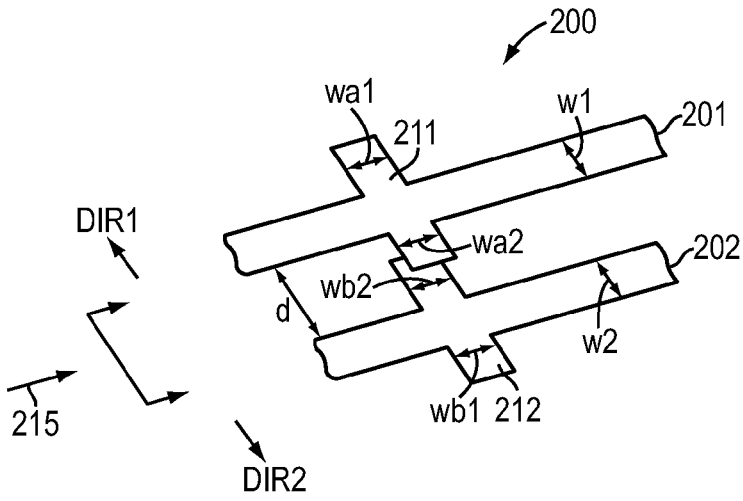
FIG. 2A is a perspective view of a portion of a directional coupler.
Figure 2B:
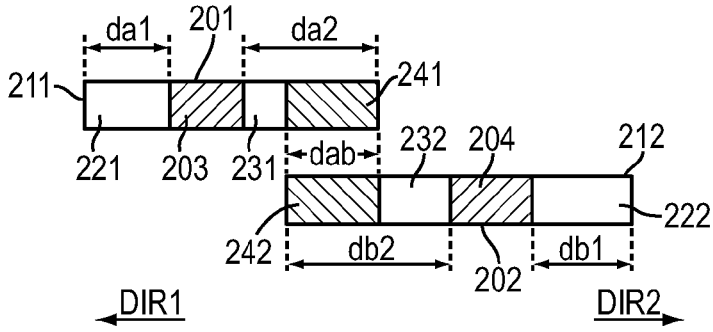
FIG. 2B is an elevational view of the portion illustrated in FIG. 2A.

A portion 200 of another embodiment of a directional coupler according to the present invention is shown in FIG. 2A. The distance between conductor 201 and conductor 202, measured along direction DIR1, is denoted as d. A flap 211 of the first conductor 201 projects substantially orthogonally to conductor 201, and similarly, a flap 212 of the second conductor 202 projects substantially orthogonally to conductor 202. The arrangement of flaps according to this embodiment is best understood with reference to FIG. 2B, which shows a view of section 200 of FIG. 2A in the direction 215. In FIG. 2B, the shaded region 203 is a cross-section of conductor 201. It can be seen that a first portion 221, of length da1 and width wa1, of flap 211 of conductor 201 projects substantially orthogonally to conductor 201 in direction DIR1. A second portion 231, of length da2 and width wa2, of flap 211 projects in the opposite direction, i.e., direction DIR2.

The shaded region 204 is a cross-section of conductor 202. A first portion 222, of length db1 and width wb1, of flap 212 projects substantially orthogonally from conductor 202 in direction DIR2, and a second portion 232, of length db2 and width wb2, of flap 212 projects in the opposite direction, i.e., direction DIR1. In the embodiment illustrated in FIG. 2B, conductor 201 and conductor 202 are arranged such that a portion 241 of flap 211 overlaps a portion 242 of flap 212, without making contact therewith. The length of the overlapping portions 241 and 242 of flaps 211 and 212, respectively, is denoted dab 250.

Figure 3:
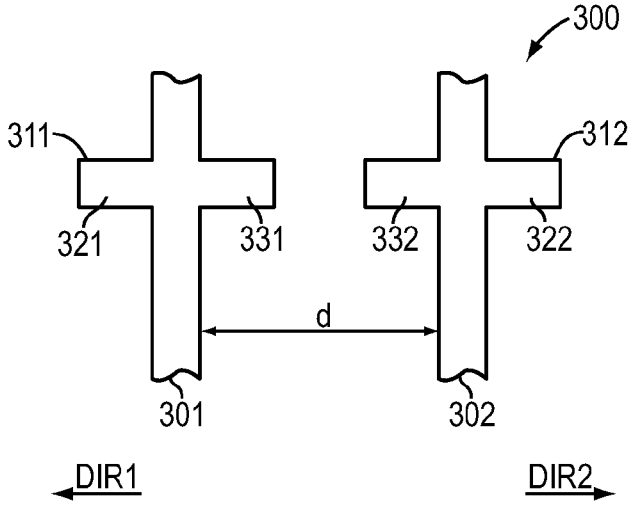
FIG. 3 is a plan view of a portion of another embodiment of a directional coupler.

Another embodiment of a directional coupler according to the present invention in which the flaps do not overlap is illustrated in FIG. 3. Specifically, FIG. 3 shows a portion 300 of a directional coupler according to the present invention. A first conductor 302 is arranged substantially parallel to a second conductor 301, at a distance d. A flap 311 of conductor 301 projects substantially orthogonally to conductor 301. A first portion 321 of flap 311 projects in direction DIR1, and a second portion 331 of flap 311 projects in the opposite direction, i.e., direction DIR2. Similarly, flap 312 of conductor 302 projects substantially orthogonally to conductor 302. A first portion 322 of flap 312 projects in direction DIR2, and a second portion 332 of flap 312 projects in the opposite direction, i.e., DIR1. In this embodiment, no portion of flap 311 of conductor 301 overlaps with flap 312 of conductor 302, or with any other flaps (not shown) of conductor 302.

These embodiments illustrate two different possible configurations and variable portions of coupler designs in accordance with the present invention. The various structural elements correspond to electrical properties, and may be optimized to achieve a desired characteristic or performance. In particular, the distance between the two conductors determines, in part, the mutual inductance between the two conductors. The distance between two adjacent flaps dictates, at least in part, the inductance of the part of the conductor that extends between the two adjacent flaps. The length and width of a part of a flap of one conductor that projects away from the other conductor dictate, at least in part, the capacitance between the flap and ground. The length and width of a part of a flap of a conductor projecting toward the other conductor dictate, at least in part, a coupling capacitance. Therefore, by selecting a configuration and optimizing the various lengths and widths—i.e., the distance between the conductors, the length of the conductor between adjacent flaps, the length and width of each flap, and whether and to what each flap projects in both directions away from the conductor from which it originates—the values of inductances and capacitances associated with a section of a coupler can be controlled. Controlling these values for one or more sections, in turn, allows a desired coupling to be achieved between the two conductors while maintaining high directivity. In addition, the length of the two conductors may thereby be minimized.

Figure 4A:
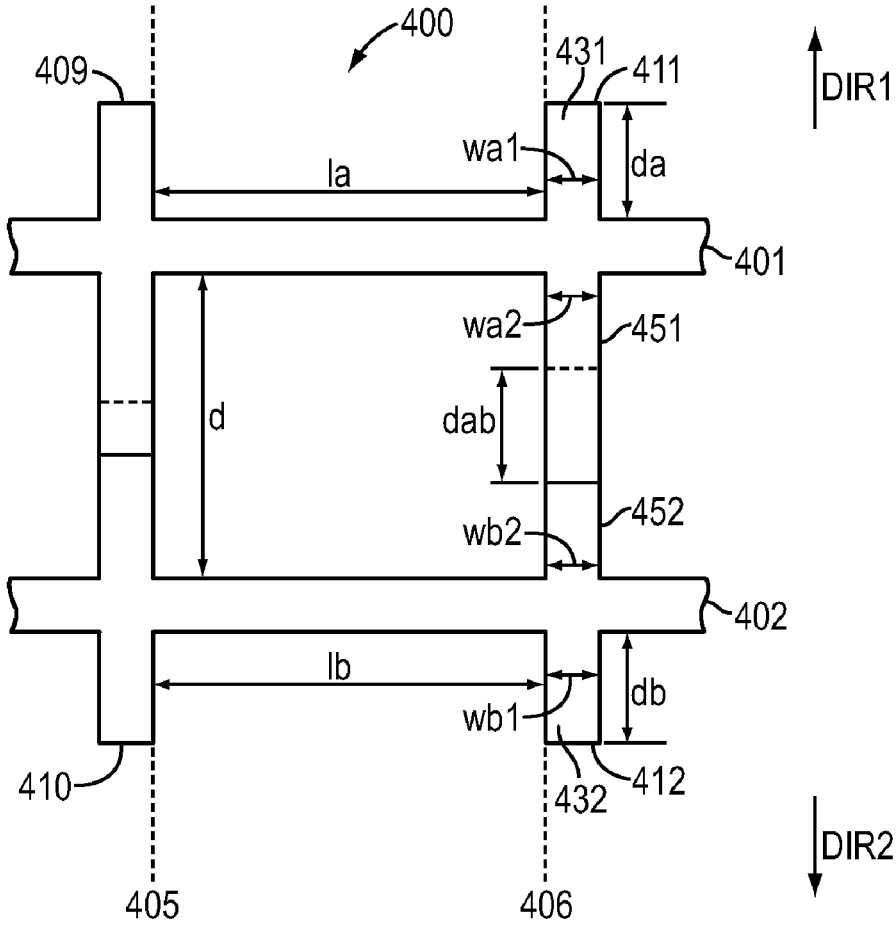
FIG. 4A is a plan view of a portion of an embodiment of a directional coupler.
Figure 4B:
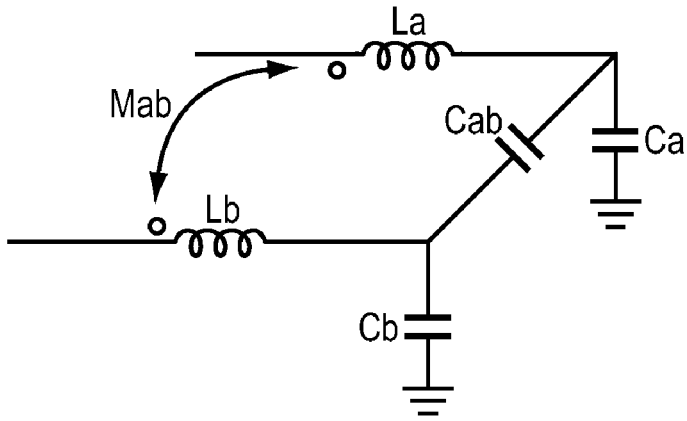
FIG. 4B illustrates a circuit equivalent to the portion illustrated in FIG. 4A.

This is illustrated in FIGS. 4A and 4B. FIG. 4A shows a top view of a portion of an embodiment of a directional coupler in which the two parallel conductors do not overlap, but portions of flaps extending from the conductors do overlap. The distance between dashed lines 405, 406 corresponds to a segment 400 of the directional coupler. The electrical properties of segment 400 correspond to various components of the circuit shown in FIG. 4B. The length la of conductor 401 is the distance between adjacent flaps 409, 411. In FIG. 4B, inductor La represents the inductance associated with the length la of conductor 1 401. Similarly, the length lb of conductor 402 is the distance between adjacent flaps 410, 412. Inductor Lb in FIG. 4B represents the inductance associated with the length lb of conductor 402. The inductance Mab in FIG. 4B represents the mutual inductance between conductors 401 and 402, and the mutual inductance Mab is associated with the distance between conductors 401, 402, denoted as d.

The flap 411 of conductor 401 has a portion 431, of width wa1, that extends a distance da from conductor 401 in direction DIR1. Flap 411 also has a portion 451, of width wa2, that extends from conductor 401 in the opposite direction DIR2. Similarly, flap 412 of conductor 402 has a portion 432, of width wb1, that extends a distance db from conductor 402 in direction DIR2, and a portion 452, of width wb2, projecting in the opposite direction DIR1. Portion 451 of flap 411 partially overlaps portion 452 of flap 412 by a distance dab.

In FIG. 4B, a capacitance Ca is associated with portion 431 of flap 411, and a capacitance Cb is associated with portion 432 of flap 412. A coupling capacitance Cab is associated with the overlap length dab of flaps 411, 412. In various embodiments of a directional coupler according to the present invention, the lengths and widths identified above are selected for each section of the coupler in order to achieve desired electrical properties as exemplified in the circuit shown in FIG. 4B. It should be noted that the various lengths d, la, lb, da, db, and dab, and various widths wa1, wa2, wb1, and wb2 can be consistent across the length of the conductors 401, 402 or can vary across the length, depending on the application and the electrical characteristics to be achieved.

While the invention has been particularly shown and described with reference to specific embodiments, it will be understood by those skilled in the art that various changes in form and detail may be made therein without departing from the spirit and scope of the invention as defined by the appended claims. The scope of the invention is thus indicated by the appended claims and all changes that come within the meaning and range of equivalency of the claims are therefore intended to be embraced.

What is claimed is:

1. A microwave directional coupler comprising:

a first conductor comprising a first transmission line;

a second conductor comprising a second transmission line, the second conductor spaced apart from but parallel to the first conductor;

a plurality of spaced-apart flaps projecting from the first conductor; and a plurality of spaced-apart flaps projecting from the second conductor, the second-conductor flaps being non-coplanar with the first-conductor flaps, wherein at least a portion of the first-conductor flaps overlaps with and is capacitively coupled with at least a portion of the second-conductor flaps without contact therewith.

2. The microwave directional coupler of claim 1, wherein at least a portion of the first-conductor flaps projects in a first direction substantially orthogonal to an axial dimension of the first conductor.

3. The microwave directional coupler of claim 1, wherein at least a portion of the first-conductor flaps projects in a second direction substantially orthogonal to an axial dimension the first conductor.

4. The microwave directional coupler of claim 2, wherein at least a portion of the first-conductor flaps projects in a second direction substantially orthogonal to the axial dimension of the first conductor, wherein the second direction is opposite to the first direction.

5. The microwave directional coupler of claim 1, wherein at least a portion of the second-conductor flaps projects in a first direction substantially orthogonal to an axial dimension of the second conductor.

6. The microwave directional coupler of claim 1, wherein at least a portion of the second-conductor flaps projects in a second direction substantially orthogonal to an axial dimension of the second conductor.

7. The microwave directional coupler of claim 5, wherein at least a portion of the second-conductor flaps projects in a second direction substantially orthogonal to the axial dimension of the second conductor, wherein the second direction is opposite to the first direction.

8. The microwave directional coupler of claim 1, wherein the first and second conductors are separated by a distance such that a pre-selected coupling factor is associated with the microwave directional coupler, and microwave signals traveling across the coupler have even-mode phase velocities and odd-mode phase velocities that are substantially similar.

9. The microwave directional coupler of claim 1, wherein the first-conductor flaps are separated by at least a distance such that a pre-selected coupling factor is associated with the microwave directional coupler, and microwave signals traveling across the coupler have even-mode velocities and odd-mode velocities that are substantially similar.

10. The microwave directional coupler of claim 1, wherein the second-conductor flaps are separated by at least a distance such that a pre-selected coupling factor is associated with the microwave directional coupler, and microwave signals traveling across the coupler have even-mode phase velocities and odd-mode phase velocities that are substantially similar.

11. The microwave directional coupler of claim 4, wherein the portion of the first-conductor flaps projecting in the first direction and the portion of the first-conductor flaps projecting in the second direction have lengths or widths such that a pre-selected coupling factor is associated with the microwave directional coupler, and microwave signals traveling across the coupler have even-mode phase velocities and odd-mode phase velocities that are substantially similar.

12. The microwave directional coupler of claim 7, wherein the portion of the second-conductor flaps projecting in the first direction and the portion of the second-conductor flaps projecting in the second direction have lengths or widths such that a pre-selected coupling factor is associated with the microwave directional coupler, and microwave signals traveling across the coupler have even-mode phase velocities and odd-mode phase velocities that are substantially similar.

13. The microwave directional coupler of claim 1, wherein the overlapping portions of the first-conductor flaps and second-conductor flaps have lengths or widths such that a pre-selected coupling factor is associated with the microwave directional coupler, and microwave signals traveling across the coupler have even-mode phase velocities and odd-mode phase velocities that are substantially similar.

14. The microwave directional coupler of claim 9, wherein each flap, except for a first flap, is separated from the immediately preceding flap by a distance that does not vary between flaps.

15. The microwave directional coupler of claim 10, wherein each flap, except for a first flap, is separated from the immediately preceding flap by a distance that does not vary between flaps.

16. The microwave directional coupler of claim 9, wherein the flaps are separated by a plurality of distances.

17. The microwave directional coupler of claim 10, wherein the flaps are separated by a plurality of distances.

18. A microwave directional coupler comprising:

a first conductor comprising a first transmission line;

a second conductor comprising a second transmission line, the second conductor spaced apart from but parallel to the first conductor;

a plurality of spaced-apart flaps projecting from the first conductor in a first direction towards the second conductor; and a plurality of spaced-apart flaps projecting from the second conductor in a second direction towards the first conductor, the second-conductor flaps being non-coplanar with the first-conductor flaps.

19. The microwave directional coupler of claim 18, wherein the first direction is substantially orthogonal to an axial dimension of the first conductor.

20. The microwave directional coupler of claim 18, wherein the second direction is substantially orthogonal to an axial dimension of the second conductor.

21. The microwave directional coupler of claim 18, wherein the second direction is substantially opposite to the first direction.

22. The microwave directional coupler of claim 18, further comprising a second plurality of spaced-apart flaps projecting from the first conductor in the second direction.

23. The microwave directional coupler of claim 18, further comprising a second plurality of spaced-apart flaps projecting from the second conductor in the first direction.

24. The microwave directional coupler of claim 18, wherein the first and second conductors are separated by a distance such that a pre-selected coupling factor is associated with the microwave directional coupler, and microwave signals traveling across the coupler have even-mode phase velocities and odd-mode phase velocities that are substantially similar.

25. The microwave directional coupler of claim 18, wherein the first-conductor flaps are separated by at least a distance such that a pre-selected coupling factor is associated with the microwave directional coupler, and microwave signals traveling across the coupler have even-mode velocities and odd-mode velocities that are substantially similar.

26. The microwave directional coupler of claim 25, wherein each flap, except for a first flap, is separated from the immediately preceding flap by a distance that does not vary between flaps.

27. The microwave directional coupler of claim 25, wherein the flaps are separated by a plurality of distances.

28. The microwave directional coupler of claim 18, wherein the second-conductor flaps are separated by at least a distance such that a pre-selected coupling factor is associated with the microwave directional coupler, and microwave signals traveling across the coupler have even-mode phase velocities and odd-mode phase velocities that are substantially similar.

29. The microwave directional coupler of claim 28, wherein each flap, except for a first flap, is separated from the immediately preceding flap by a distance that does not vary between flaps.

30. The microwave directional coupler of claim 28, wherein the flaps are separated by a plurality of distances.

31. The microwave directional coupler of claim 18, wherein a portion of the first-conductor flaps overlaps with a portion of the second-conductor flaps.

32. The microwave directional coupler of claim 31, wherein the overlapping portions of the first-conductor flaps and second-conductor flaps have lengths or widths such that a pre-selected coupling factor is associated with the microwave directional coupler, and microwave signals traveling across the coupler have even-mode phase velocities and odd-mode phase velocities that are substantially similar.

33. The microwave directional coupler of claim 18, wherein the first-conductor flaps and the second-conductor flaps do not overlap.

* * * * *